United States Patent [19]

Negrussi

[11] Patent Number: 5,022,251

[45] Date of Patent: Jun. 11, 1991

[54] FAST COUPLING FOR ROLLER REPLACEMENT

[75] Inventor: Luigi Negrussi, Sartirana Lomellina, Italy

[73] Assignee: Sted Engineering S.r.l., Italy

[21] Appl. No.: 430,807

[22] Filed: Nov. 2, 1989

[51] Int. Cl.[5] ..... B21B 31/08

[52] U.S. Cl. ..... 72/239; 101/216; 101/219

[58] Field of Search ..... 72/238, 239; 101/216, 101/217, 218, 219, 247

[56] References Cited

U.S. PATENT DOCUMENTS

| | | | |
|---|---|---|---|
| 2,460,504 | 2/1949 | Huebner | 101/216 |
| 3,625,145 | 12/1971 | Heatley, Jr. et al. | 101/152 |

FOREIGN PATENT DOCUMENTS

| | | | |
|---|---|---|---|
| 0234456 | 9/1987 | European Pat. Off. | 101/219 |
| 1130451 | 5/1962 | Fed. Rep. of Germany | 101/216 |
| 2336791 | 2/1975 | Fed. Rep. of Germany | 101/247 |
| 2485990 | 1/1982 | France | 101/216 |

*Primary Examiner*—Lowell A. Larson
*Assistant Examiner*—Thomas C. Schoeffler
*Attorney, Agent, or Firm*—Bucknam and Archer

[57] ABSTRACT

In a machine such as a printer, mill, and similar machines, the fast coupling system for the replacement of the rollers comprises two vertical slides, each one of the slides being provided at the bottom with a fixed jaw and a movable jaw. The jaws form a circular seat. Each roller has an idle bush which engages with the circular seat.

6 Claims, 2 Drawing Sheets

FAST COUPLING FOR ROLLER REPLACEMENT

The present invention relates to a fast coupling system for the replacement of rollers, e.g. rollers for printers and similar machines. The fast coupling system comprises two end side slides which slide on tracks and are activated by pistons. Each slide is equipped, at the bottom, with a fixed and a movable jaw, aligned to each other and adjusted to engage in the idle bushes applied at the ends of the supporting pins of the rollers, for instance rollers for printers. Each of the movable jaws is driven by a piston and is equipped with return spring means, mainly for safety. The unit also comprises two end brackets, tippable, to support and maneuver the rollers in the extraction and/or in the insertion phase.

It is known that, in machines with rollers, e.g. machines for printing, for the rolling of films etc., one of the trickiest, longest operations is the replacement of the rollers, at the end of each production cycle and at the start of another, or for maintenance etc. This operation is at present extremely difficult because the rollers are substantially supported by supports and do not present any coupling and/or support apart from the end collars. For this, each replacement operation involves the presence of lifting and supporting means external to the structures supporting the rollers and the intervention of various operators to facilitate extraction and/or insertion of the rollers without causing damage to their surfaces or to the surrounding structures, and to guarantee maximum operating safety. At any rate, even taking all possible precautions, it may still happen that undesired damage is caused to both structures and persons. The object of this present invention is to eliminate the above problems.

The invention, as defined by the claims, solves the problem through a fast coupling system for the replacement of rollers, with which the following results are obtained: the entire coupling device forms an integral part of the lateral supporting structures, or shoulders, of the machines using rollers, such as printing machines, mills etc.; the extractable rollers are equipped with end bushes with which the lifting jaws engage; end collars for support are connected to the bushes. Tippable brackets are provided set at the side ends of the machine and support the rollers during the intermediate phases of extraction and/or insertion.

The advantages of this invention mainly consist of the fact that the insertion and/or extraction operations of the rollers take place quickly and safely, no accessories external to the supporting structures are required, apart from the only means of movement and transport of the rollers; the supplementary structures applied to the shoulders of the machines are of simple construction, easy to apply, rapid and safe to use and their total cost is widely compensated by the savings of time in changing rollers.

The invention is illustrated in its preferred, but not limiting form of construction, with reference to the attached drawings, in which.

Figure 1:
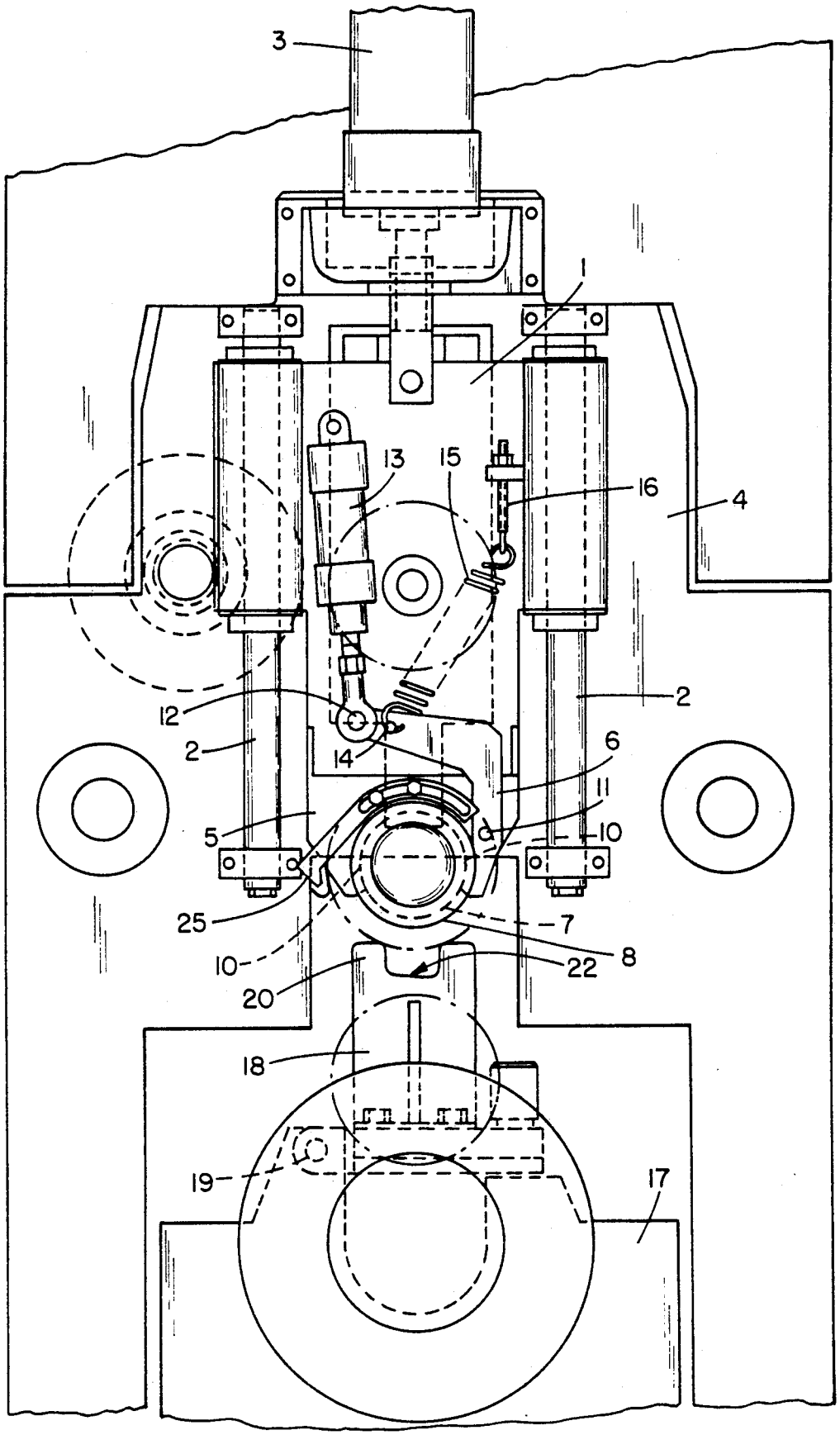
FIG. 1 shows the overall view of a side supporting structure, or shoulder, of a printing machine with rollers, equipped with the fast coupling system of this present invention.
Figure 2:
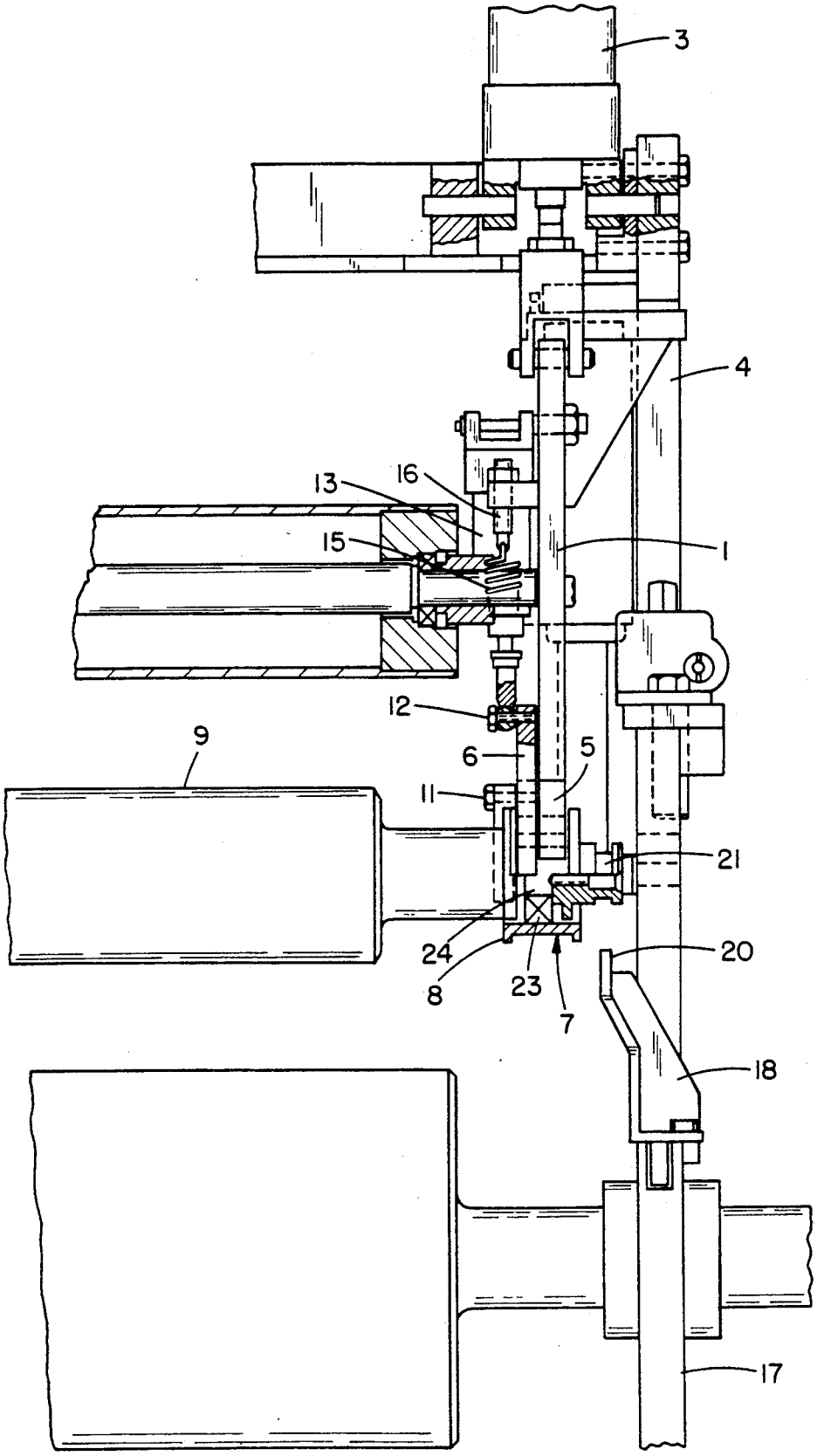
FIG. 2 shows the side sectional-view of the same shoulder as in FIG. 1.

The figures illustrate a fast coupling for the replacement of rollers, applied for example to a side supporting shoulder of a printing machine. In the same machine are applied two fast couplings, positioned, respectively, on the opposite side shoulders, forming the supporting and guiding structure of the ends of the rollers. Each fast coupling substantially comprises a vertical slide (1), sliding vertically along the side track (2) and driven by an upper primary piston (3). The tracks (2) and piston (3) are substantially fixed to the supporting structure (4) of each side shoulder. On the lower part of each vertical slide (1) are applied a fixed jaw (5) and a movable jaw (6), opposite, and forming a single seat in which is engaged the collar (7) of the idle bushes (8), installed at the ends of the interchangeable rollers (9). The seat of engagement, formed by the opposite jaws (5) and (6), has substantially a circular form, open at the bottom, and is coupled to each collar (7), winding around the entire upper semicircumference of the seat and two adjoining opposite zones which project beyond the horizontal diameter from two sides and partially extend along the lower semicircumference. The opposite zones (10) form the circular opposite sectors of the lower semicircumference of the seat of engagement and serve, during the lifting operations, to grip and support the idle bushes (8), on which rest the corresponding interchangeable rollers (9). The lower opening of the seat, being smaller than the diameter of the collar (7), of the idle bush (8), guarantees the grip of the latter, in the closing and lifting phases, and improves detachment and discharge of the rollers, in the opening phases.

Each movable jaw (6) is substantially formed by a shaped lever, supported on a pin (11) and equipped with a coupling (12), opposite its round sector (10), connected to the rod of a secondary piston (13).

In addition, near the coupling (12), each movable jaw (6) comprises a tie (14) to which is connected one end of a safety return coil spring (15) which is fixed, at the other end, to an adjustable stop (16) applied to the same slide (1). In the operative phase, e.g. to lift a roller (9), the upper pistons (3) control the slide (1) in downstroke. In this phase, the rods of the secondary pistons (13) are thrust outwards, so that the shaped levers forming the movable jaws (6) are rotated round the pins (11) and the seats are opened at the bottom to allow insertion of the idle bushes (8). The downstroke of the slides (1) ends when the upper semicircumferences of the above mentioned seats reach the top surface of the rollars (7) of the underlying idle bushes (8) located at the ends of a roller (9).

To carry out this operation, the vertical slides (1) are capable of making an oscillation to allow the round sectors (10) of the fixed jaws (5) to project beyond the diameter of the collars (7) of the idle bushes (8) and to grip one or another, subsequently, on their lower semicircumference. When the downstroke of the slide (1) is complete, the rods of the secondary pistons (13) return to the original position and the movable jaws (6) close, engaging with the idle bushes (8). Closure of the movable jaws (6), in addition to the action of the pistons (13), is guaranteed by the return action of the safety return spring (15).

Once the idle bushes (8) are gripped, with the fixed (5) and movable (6) jaws coupled and closed, and the springs (15) in traction, the rollers (9) can be lifted. Lifting is obtained by driving in opposite direction the upper primary pistons (3); the vertical slides (1) slide upwards along the tracks (2) and the entire system is lifted. In alignment with the side supporting structures (4), and at the bases (17), are positioned tippable brackets (18), supported on pins (19).

After the lifting of an interchangeable roller (9), the above mentioned brackets (18), normally tipped laterally so as not to disturb the movement of the machines during the operating phases, are rotated upwards and positioned in alignment with the roller being lifted. In this position, the seatings (20) of the brackets (18) are aligned with the collars (21) located at the ends of the rollers (9), coaxially to the idle bushes (8). Driving the primary pistons (3) downwards, the collars (21) are engaged in the seatings (20), and, in that position, the movable jaws (6) may be re-opened and the roller (9) is supported by the above mentioned brackets (18).

By lifting the vertical slides (1), the roller (9) supported by the brackets (18) is in correct position and convenient for extraction and replacement. The seatings (20) have the bottom (22) inclined; this serves to facilitate, during the opening of the movable jaws (6), a slight rolling of the roller (9) towards the lower part of the bottoms (22) and a displacement of same sufficient to facilitate extraction of the fixed jaws (5).

To facilitate the movement and positioning of the rollers (9) during the lifting and/or lowering phases, the idle bushes (8) are preferably, but not necessarily installed on roller bearings (23), keyed on the ends (24) of the rollers (9), forming the supports on which the collars (21) are fixed. Safety means (25) are provided in compliance with safety regulations. From what has been illustrated and described it will be clear to one skilled in the field that the fast coupling system of the present invention may be applied on any machine equipped with roller movement, e.g. mills, printing machines, presses, etc. Also, it should be understood that various structural modifications may be necessary to adapt the coupling system of this invention to different types of machines.

I claim:

1. In a machine having rollers (9), said machine having a side structure (4), a fast coupling system for the replacement of said rollers, said coupling system being fixed to said side structure, said coupling system comprising a pair of vertical slides (1) fixed to said side structure, a pair of lateral tracks (2), said slides sliding along said tracks, a pair of first pistons (3) actuating said slides to move along said tracks, a fixed jaw and a movable jaw at the bottom of each of said slides, said jaws being aligned and forming a circular seat, said seat being open in the lower part thereof to form an opening regulated by said movable jaw, each of said rollers having a supporting pin, each of said pins having at one end an idle bush and a first collar (7), said seat having a horizontal diameter and being shaped to form an upper semicircumference and two opposite circular sectors (10) along the lower semicircumference, said sectors projecting beyond said horizontal diameter, said first collar engaging in said circular seat; said roller having a second collar (21) fixed at its end, said side structure having a base, two flippable brackets (18) fixed to said base on the side of said structure of said machine and aligned with said second collar.

2. The fast coupling system according to claim 1 wherein each movable jaw (6) is formed by a shaped lever, supported by an intermediate pin (11) and provided with a coupling (12), opposite each of said round sectors (10), and the system comprises a second piston (13), said second piston has a rod connected to said coupling (12).

3. The fast coupling system according to claim 2 wherein each said lever comprises a tie (14) connected to one end of a safety return elastic means (15), said elastic means being connected, at the other end, to an adjustable stop (16).

4. The fast coupling according to claim 3 wherein the vertical slides (1) oscillate laterally whereby each of said round sectors projects beyond each of said first collars (7).

5. The fast coupling system according to claim 4 wherein each of said idle bushes (8) is provided with a roller bearing (23), said roller bearing keyed at the end of each roller (9).

6. The fast coupling according to claim 5 wherein each tippable bracket (18) has a supporting second seat (20), said second seat having an inclined bottom (22), said second collar (21) engaging with said second seat.

* * * * *